US005368983A

United States Patent [19]

Okamoto

[11] Patent Number: 5,368,983

[45] Date of Patent: Nov. 29, 1994

[54] METHOD FOR FORMING AN IMAGE

[75] Inventor: Yasuhiro Okamoto, Kanagawa, Japan

[73] Assignee: Fuji Photo Film Co., Ltd., Kanagawa, Japan

[21] Appl. No.: 141,010

[22] Filed: Oct. 26, 1993

[30] Foreign Application Priority Data

Oct. 26, 1992 [JP] Japan ..... 4-287822

[51] Int. Cl.[5] ..... G03C 5/29

[52] U.S. Cl. ..... 430/264; 430/265; 430/438; 430/439; 430/481; 430/482

[58] Field of Search ..... 430/264, 265, 268, 435, 430/436, 438, 439, 440, 441, 442, 446, 464, 478, 480, 481, 482, 483, 485, 966

[56] References Cited

U.S. PATENT DOCUMENTS 4,416,980 11/1983 Fujiwhara et al. ..... 430/438
4,818,659 4/1989 Takahashi et al. ..... 430/265
5,114,836 5/1992 Sato et al. ..... 430/438
5,266,442 11/1993 Ooms ..... 430/438

FOREIGN PATENT DOCUMENTS 1179145 7/1989 Japan .

*Primary Examiner*—Hoa Van Le
*Attorney, Agent, or Firm*—Sughrue, Mion, Zinn, Macpeak & Seas

[57] ABSTRACT

A method for forming an image provides high sensitivity, high contrast, and reduced fluctuation in performance due to the deterioration of processing solutions. The method comprises processing a silver halide photographic material having on a support at least two silver halide emulsion layers having different sensitivities, with the emulsion layer closer to the support having a higher sensitivity, in a developing solution containing a di- or trihydroxybenzene compound and a 3-pyrazolidone compound or a developing solution containing a di- or trihydroxybenzene compound and an aminophenol compound in the absence of a hydrazine compound, wherein a characteristic curve obtained has a gradient (a $\gamma$ value) of 6.0 or more in the segment of the curve from D=0.1 to D=3.0 where D is the density.

7 Claims, No Drawings

METHOD FOR FORMING AN IMAGE

FIELD OF THE INVENTION

The present invention relates to a method for forming an image with a silver halide photographic material. More specifically, the invention relates to a method for forming an image with a black-and-white silver halide photographic material for obtaining a silver image. The method of the invention provides high sensitivity, high contrast, and reduced fluctuation in performance due to deterioration of processing solutions.

BACKGROUND OF THE INVENTION

In a line photographing process for a photographic plate making, an original typically is made by applying a phototypesetting character, a hand written character, an illustration, or a halftone-dotted photograph. This original is photographed with a plate making camera. The plate making camera is so designed that the exposure is controlled by the exposing time, and a photographic material having a higher sensitivity can be subjected to photographing in a shorter time. The shortening of delivery dates is required in the printing industry and this requires a photographic material having a higher sensitivity.

In the plate making field, a photographic material having a high contrast and a method for preparing it are required and various attempts therefor have so far been made. There have been developed the methods having a developing effect, such as a method in which a silver halide photographic material is processed in a developing solution having a very low sulfite ion concentration (a so-called lithographic developing system) and a method in which a silver halide photographic material containing a hydrazine derivative is processed in a developing solution having a high pH. In addition thereto, a method in which a rhodium salt is doped in the silver halide grains has been applied as a contrast increasing method in which the developing effect is not used.

As described above, high sensitivity and high contrast have been required in the plate making field. In recent years, simplification of processing methods and reduction of the amount of processing waste water have been required in addition thereto. This has required processes which maintain a high contrast even with a small replenishing amount.

The methods in which two or more silver halide emulsion layers are used and in addition, an image having a high contrast is formed are described in JP-A-51-50736 (the term "JP-A" as used herein means an unexamined published Japanese patent application), 62-235939, 62-90646, 62-150343, 63-15237, and 63-46437. In these methods, a high contrast is provided by the developing effect described above and the high contrast is not given by providing two or more silver halide emulsion layers.

An increase in the contrast by the provision itself of two or more silver halide emulsion layers each having a different sensitivity is described in JP-A-1-179145 but this method does not provide the high contrast required in the plate making field.

SUMMARY OF THE INVENTION

A first object of the present invention is to provide a method for forming an image having a high contrast without using a developing effect.

A second object of the present invention is to provide a method for forming an image having a high contrast, in which a reduction of the replenishing amounts of processing solutions does not cause a reduction in sensitivity.

The above objects of the present invention have been achieved by a method for forming an image, comprising processing a silver halide photographic material having on a support at least two silver halide emulsion layers having different sensitivities, with the emulsion layer closer to the support having a higher sensitivity, in a developing solution containing a di-or trihydroxybenzene compound and a 3-pyrazolidone compound or in a developing solution containing a di- or trihydroxybenzene compound and an aminophenol compound in the absence of a hydrazine compound, wherein a characteristic curve obtained has a gradient (a $\gamma$ value) of 6.0 or more in the segment of the curve from $D=0.1$ to $D=3.0$ where D is the density.

The characteristic curve may be given by detecting a density of images and plotting a density vasus various exposures in the sample, which was obtained by exposing through step-wedge, and developing thereof. As for an exposing light source, tungusten light, Xenon light and laser beam may be used, tungusten light is the most preferable.

DETAILED DESCRIPTION OF THE INVENTION

The present invention is described in detail below.

In the silver halide photographic material used in the present invention having at least two silver halide emulsion layers on a support, the two silver halide emulsion layers have different sensitivities and the silver halide emulsion layer closer to the support has a higher sensitivity. There can be enumerated as methods for changing the sensitivity of a silver halide emulsion layer, the methods for changing the sensitivity by changing the rhodium salt content in the silver halide grains, the halogen composition, the degree of chemical sensitization, the grain size, the amount of sensitizing dye added to the silver halide emulsion layer, the anti-fogging agent, or the kind and amount of stabilizer. Of these methods, the method in which the rhodium salt content is changed is particularly preferred.

The preferred sensitivity difference between the two emulsion layers varies according to the grain size of the silver halide grains, the halogen composition, the amount of sensitizing dye added to a particular silver halide emulsion layer, the layer thickness, and the silver amount. The difference is preferably 0.05 log E to 0.5 log E.

The silver halide in the silver halide photographic emulsions according to the present invention may be any of silver chloride, silver bromide, silver bromochloride, silver bromochloroiodide, and silver bromoiodide. The silver chloride content of the silver halide is preferably 30 mole % or more, more preferably 50 mole % or more. The silver iodide content of the silver halide is preferably 5 mole % or less, more preferably 2 mole % or less. The silver halide grains preferably have an average grain size of 0.01 to 1 $\mu$m, more preferably 0.4 $\mu$m or less. The grains preferably have a narrow grain size distribution in which the variation coefficient represented by (standard deviation of the grain size/average grain size)$\times$100 is 15% or less, more preferably 10% or less.

The silver halide grains may have either a structure in which the inside and surface compositions are homogeneous or a structure in which the inside and surface compositions are different.

The emulsions used in the present invention can be prepared by the methods described in *Chemie et Physique Photographique* written by P. Glafkides (published by Paul Montel Co., Ltd., 1967), *Photographic Emulsion Chemistry* written by G. F. Duffin (published by The Focal Press Co., Ltd., 1966), and *Making and Coating Photographic Emulsion* written by V. L. Zelikman, (published by The Focal Press Co., Ltd., 1964).

That is, there may be used any of an acid method, a neutral method and an ammonia method. Any of a single jet method, a double jet method and combinations thereof may be used as the method for reacting a water soluble silver salt with a water soluble halide.

There can be used as well the method in which the grains are formed under the presence of excess silver ions (a so-called reverse mixing method). There can be used as one form of the double jet method, the method in which the pAg of the solution in which the silver halide grains are formed is maintained constant, a so-called controlled double jet method.

With the controlled double jet method, a silver halide emulsion having a regular crystal form and an almost uniform grain size can be obtained.

In order to obtain a uniform grain size, it is preferred to grow the silver halide grains rapidly in the range not exceeding the critical saturation degree using the method in which the addition speeds of silver nitrate and alkali halide are changed in accordance with the grain growing speed as described in British Patent 1,535,016 and JP-B-49-36890 (the term "JP-B" as used herein means an examined Japanese patent publication) and JP-B-52-16364. Alternatively, the method in which the concentrations of the aqueous solutions are changed as described in British Patent 4,242,445 and JP-A-55-158124 can be used.

The grains contained in the silver halide emulsions of the present invention are preferably formed in the presence of a silver halide solvent such as a tetra-substituted thiourea or an organic thioether compound.

The preferred tetra-substituted thiourea silver halide solvents used in the present invention are the compounds described in JP-A-53-82408 and JP-A-55-77737.

The organic thioether silver halide solvent preferably used in the present invention is a compound containing at least one group in which an oxygen atom and a sulfur atom are separated by an ethylene group (for example, —O—$CH_2CH_2$—S—) as described in, for example, JP-B-47-11386 (U.S. Pat. No. 3,574,628) or a chain thioether compound having an alkyl group at both terminals (these alkyl groups each have at least two substituents selected from hydroxy, amino, carboxy, amide and sulfone) as described in JP-A-54-155828 (U.S. Pat. No. 4,276,374).

The amount of the silver halide solvent to be added will vary according to the kind of the compound used, the described grain size and the halogen composition. It is preferably $10^{-5}$ to $10^{-2}$ mole per mole of silver halide.

In the case where the use of the silver halide solvent increases the grain size to a size greater than the desired size, the desired grain size can be obtained by changing the temperature during the formation of the grains and the addition timing of the silver salt solution and the halide solution.

The silver halide emulsions according to the present invention may contain Group VIII metals. In particular, the use of a rhodium salt such as rhodium chloride or ammonium hexachlororhodate (III) can provide an emulsion having a hard gradation and therefore is advantageous. Further, the use of an iron salt such as potassium hexacyanoferrate (II) or ferrous thiocyanate can provide an emulsion having a high sensitivity and therefore is advantageous.

These metals can be used alone or in combination. The metal compounds can be added at any step during the preparation of the silver halide emulsion or at any time before coating the emulsion.In particular, they are preferably added during grain formation to allow them to be incorporated into the silver halide grains.

The silver halide emulsion in the present invention is usually subjected to a chemical sensitization. There can be used as a method for the chemical sensitization, a sulfur sensitizing method, a selenium sensitizing method, a reduction sensitizing method, or a noble metal sensitizing method, and they can be used singly or in combinations thereof.

Conventional selenium compounds disclosed in the patent literature can be used to carry out selenium sensitization of the emulsions for use in the present invention. That is, an unstable type selenium compound and/or a non-unstable type selenium compound are usually added and used by stirring an emulsion at an elevated temperature, preferably at 40° C. or higher for a fixed time. Preferred unstable selenium compounds, include the compounds described in JP-B-44-15748 and JP-B-43-13489, and JP-A-4-25832 and JP-A-4-109240. Specific examples of unstable selenium sensitizers, include isoselenocyanates (for example, aliphatic isoselenocyanates such as allyl isoselenocyanate), selenoureas, selenoketones, selenoamides, selenocarboxylic acids (for example, 2-selenopropionic acid and 2-selenobutyric acid), selenoesters, diacylselenides (for example, bis(3-chloro-2,6-dimethoxybenzoyl) selenide), selenophosphates, phosphineselenides, and colloidal metal selenium.

Preferred examples of unstable selenium compounds are described above but are not limited thereto. In the case of an unstable selenium compound used as a sensitizer for a photographic emulsion, the structure of the compound is not important to the person of ordinary skill in the art so long as the selenium is unstable, and it is generally understood that the organic portion of a selenium sensitizer molecule has no functions other than to carry selenium and allow it to be present in an emulsion in an unstable form. In the present invention, any unstable selenium compound consistent with this description can be used to advantage.

Examples of non-unstable selenium compounds which may be used in the present invention, include the compounds described in JP-B-46-4553, JP-B-52-34492 and JP-B-52-34491. Specific examples of non-unstable selenium compounds, include selenious acid, potassium selenocyanide, selenazoles, the quaternary salts of selenazoles, diaryl selenide, diaryl diselenide, dialkyl selenide, dialkyl diselenide, 2-selenazil-idinedione, 2-selenoxazolidinethione, and the derivatives thereof.

Of these selenium compounds, the compounds represented by the following Formulas (I) and (II) are preferred:

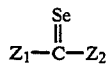

(I)

wherein $Z_1$ and $Z_2$ may be the same or different and each represents an alkyl group (for example, methyl, ethyl, t-butyl, adamantyl, and t-octyl), an alkenyl group (for example, vinyl and propenyl), an aralkyl group (for example, benzyl and phenetyl), an aryl group (for example, phenyl, pentafluorophenyl, 4-chlorophenyl, 3-nitrophenyl, 4-octylsulfamoylphenyl, and α-naphthyl), a heterocyclic group (for example, pyridyl, thienyl, furyl, and imidazolyl), $—NR_1(R_2)$, $—OR_3$, or $—SR_4$.

$R_1$, $R_2$, $R_3$, and $R_4$ may be the same or different from each other and each represents an alkyl group, an aralkyl group, an aryl group, or a heterocyclic group. The same examples as those enumerated for $Z_1$ can be enumerated for an alkyl group, an aralkyl group, an aryl group, and a heterocyclic group.

It is further provided that $R_1$ and $R_2$ each may be a hydrogen atom or an acyl group (for example, acetyl, propanoyl, benzoyl, heptafluorobutanoyl, difluoroacetyl, 4-nitrobenzoyl, α-naphthoyl, and 4-trifluoromethyl-benzoyl).

In Formula (I), $Z_1$ preferably represents an alkyl group, an aryl group, or $—NR_1(R_2)$ and $Z_2$ preferably represents $—NR_5(R_6)$. $R_1$ and $R_2$, $R_5$, and $R_6$ may be the same or different from each other and each represents a hydrogen atom, an alkyl group, an aryl group, or an acyl group.

Of the compounds represented by Formula (I), N,N-dialkylselenourea, N,N,N'-trialkyl-N'-acylselenourea, tetralykylselenourea, N,N-dialkyl-arylselenoamide, and N-alkyl-N-aryl-arylselenoamide are preferred.

Formula (II) is as follows:

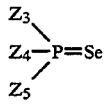

(II)

wherein $Z_3$, $Z_4$ and $Z_5$ each may be the same or different and each represents an aliphatic group, an aromatic group, a heterocyclic group, $—OR_7$, $—NR_8(R_9)$, $—SR_{10}$, $—SeR_{11}$, X, or a hydrogen atom.

$R_7$, $R_{10}$ and $R_{11}$ each represents an aliphatic group, an aromatic group, a heterocyclic group, a hydrogen atom, or a cation; $R_8$ and $R_9$ each represents an aliphatic group, an aromatic group, a heterocyclic group, or a hydrogen atom; and X represents a halogen atom.

In Formula (II), the aliphatic group represented by $Z_3$, $Z_4$, $Z_5$, $R_7$, $R_8$, $R_9$, $R_{10}$ and $R_{11}$ represents a linear, branched or cyclic alkyl group, an alkenyl group, an alkynyl group, an aralkyl group (for example, methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl, and phenetyl).

In Formula (II), the aromatic group represented by $Z_3$, $Z_4$, $Z_5$, $R_7$, $R_8$, $R_9$, $R_{10}$ and $R_{11}$ represents a monocyclic or condensed aryl group (for example, phenyl, penta-fluorophenyl, 4-chlorophenyl, 3-sulfophenyl, α-naphthyl, and 4-methylphenyl).

In Formula (II), the heterocyclic group represented by $Z_3$, $Z_4$, $Z_5$, $R_7$, $R_8$, $R_9$, $R_{10}$ and $R_{11}$ represents a 3- to 10-membered saturated or unsaturated heterocyclic group containing at least one of a nitrogen atom, an oxygen atom and a sulfur atom (for example, pyridyl, thienyl, furyl, thiazolyl, imidazolyl, and benzimidazolyl).

In Formula (II), the cation represented by $R_7$, $R_{10}$ and $R_{11}$ represents an alkali metal atom or ammonium and the halogen atom represented by X represents, for example, a fluorine atom, a chlorine atom, a bromine atom, or an iodine atom.

In Formula (II), $Z_3$, $Z_4$, or $Z_5$ each preferably represents an aliphatic group, an aromatic group, or $—OR_7$, and $R_7$ preferably represents an aliphatic group or an aromatic group.

Of the compounds represented by Formula (II), trialkyl phosphineselenide, triaryl phosphineselenide, trialkyl selenophosphate, and triaryl selenophosphate are preferred.

Specific examples of the compounds represented by Formulas (I) and (II) are shown below but the present invention is not limited thereto.

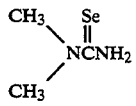

I-1

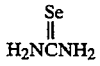

I-2

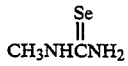

I-3

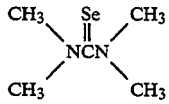

I-4

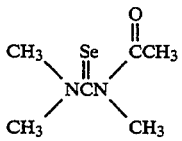

I-5

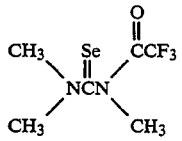

I-6

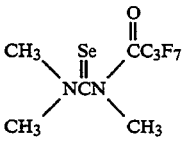

I-7

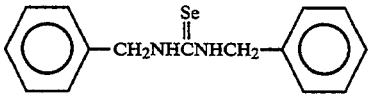

I-8

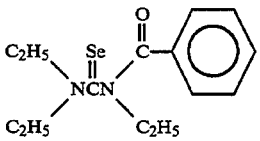

I-9

-continued
I-10
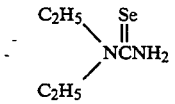
I-11
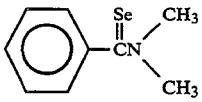
I-12
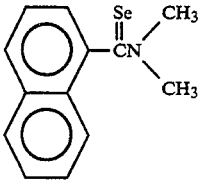
I-13
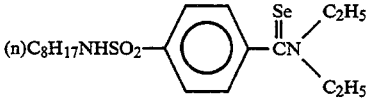
I-14
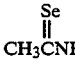
I-15
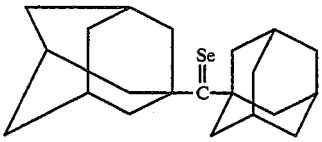
I-16
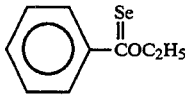
I-17
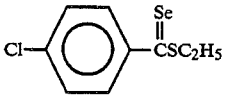
I-18
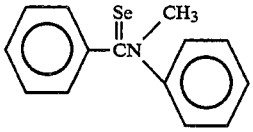
I-19
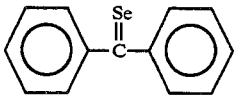
I-20
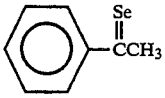
II-1
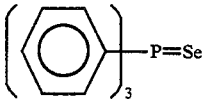
-continued
II-2
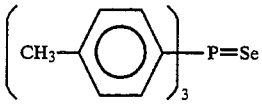
II-3
$(nC_4H_9)_3P{=}Se$
II-4
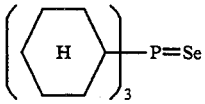
II-5
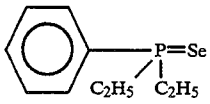
II-6
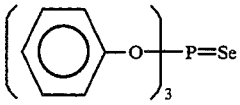
II-7
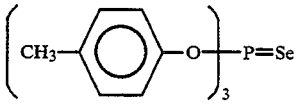
II-8
$(nC_4H_9O)_3P{=}Se$
II-9
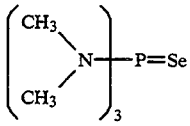
II-10
$(C_2H_5O)_3P{=}Se$
II-11
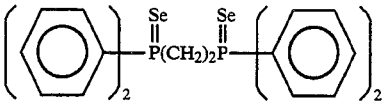
II-12
$(nC_8H_17O)_3P{=}Se$
II-13
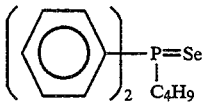
II-14
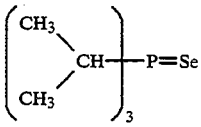
II-15
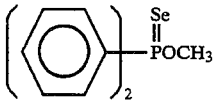

-continued

II-16

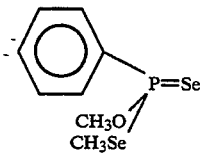

II-17

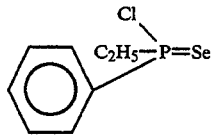

II-18

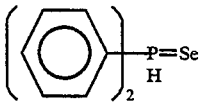

II-19

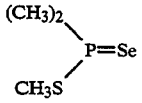

Selenium sensitizing methods suitable for use with the present invention are disclosed in U.S. Pat. Nos. 1,574,944, 1,602,592, 1,623,499, 3,297,446, 3,297,447, 3,320,069, 3,408,196, 3,408,197, 3,442,653, 3,420,670, and 3,591,385, French Patents 2,693,038 and 2,093,209, JP-B-52-34491, JP-B-52-34492, JP-B-53-295, and JP-B-57-22090, JP-A-59-180536, JP-A-59-185330, JP-A-59-181337, JP-A-59-187338, JP-A-59-192241, JP-A-60-160046, JP-A-60-151637, JP-A-61-246738, JP-A-3-4221, JP-A-3-148648, JP-A-3-111838, JP-A-3-116131, JP-A-3-237450, JP-A-4-9837, JP-A-4-25832, JP-A-4-32831, and JP-A-4-109240, British Patents 255,846 and 861,984, and *Journal of Photographic Science* written by H. E. Spencer et al, vol. 31, pp. 158–169 (1983).

The selenium sensitizers are added as part of a chemical sensitization after being dissolved in a single or mixed solvent of water or an organic solvent such as methanol or ethanol, or the selenium sensitizers are added in the forms described in JP-A-4-140738 and JP-A-4-140739. They are preferably added before starting the chemical sensitization. The selenium sensitizers to be used are not limited to a single kind and they can be used in combinations of two or more kinds of the selenium sensitizers described above. An unstable selenium compound and a non-unstable selenium compound may be used in combination.

The amount of the selenium sensitizer or sensitizers to be used in the present invention will vary according to the activity of the selenium sensitizer(s) used, the kind and size of the silver halide grains, and the temperature and time used for ripening. The total amount of selenium sensitizers is preferably $1\times10^{-8}$ mole or more, more preferably $1\times10^{-7}$ or more and $1\times10^{-5}$ or less per mole of silver halide in the emulsion layer or layers being sensitized. The temperature of the chemical ripening in which the selenium sensitizer(s) are used is preferably 45° C. or more, more preferably 50° C. or more and 80° C. or less. The pH and pAg are not critical. The effects of the present invention can be obtained in a broad pH range of, for example, 4 to 9.

The selenium sensitization is more effectively carried out in the presence of a silver halide solvent.

Specific examples of silver halide solvents which may be used in the present invention, include (a) organic thioethers as described in U.S. Pat. Nos. 3,271,157, 3,531,289, and 3,574,628, and JP-A-54-1019 and JP-A-54-158917, (b) thiourea derivatives as described in JP-A-53-82408, JP-A-55-77737, and JP-A-55- 2982, (c) silver halide solvents having a thiocarbonyl group interposed between an oxygen atom or sulfur atom and a nitrogen atom, as described in JP-A-53-144319, (d) imidazoles as described in JP-A-54-100717, (e) sulfites, and (f) thiocyanates.

The particularly preferred solvents include thiocyanate and tetramethylthiourea. The amount of the solvent to be used will vary depending on the particular solvent. For example, in the case of thiocyanate, the preferred amount thereof is $1\times10^{-4}$ or more and $1\times10^{-2}$ or less per mole of silver halide.

There can be used as a sulfur sensitizer, various sulfur compounds, for example, thiocyanate, thioureas, thiazoles, and rhodanines as well as a sulfur compound contained in gelatin.

There can be used as a reduction sensitizer, a stannous salt, amines, formamidinesulfnic acid, and a silane compound.

Of the noble metal sensitizing methods, a gold sensitizing method is typical thereof, in which a gold compound, typically a gold complex salt, is used. Noble metals other than gold may be used, for example, complex salts of platinium, palladium, and iridium may be used.

The silver halide light-sensitive emulsion according to the present invention may be subjected to a spectral sensitization to a blue light having a relatively long wavelength, a green light, a red light, or an infrared light. There can be used as a sensitizing dye, a cyanine dye, a merocynine dye, a complex cyanine dye, a complex meroyanine dye, a holopolar cyanine dye, a styryl dye, a hemicyanine dye, an oxonol dye, and a hemioxonol dye.

The sensitizing dyes may be used either singly or in combinations thereof. A combination of sensitizing dyes is often used particularly for the purpose of supersensitization. There may be incorporated into an emulsion together with the sensitizing dyes, a dye having no spectral sensitizing action by itself or a material which absorbs substantially no visible ray and which has a supersensitization effect.

Combinations of useful sensitizing dyes and dyes having a supersensitization effect and materials having a supersensitization effect are described in *Research Disclosure* vol. 176, No. 17643 (issued in December 1978), p. 23, item J in IV.

With regard to the sensitizing dyes which may be used in the context of the present invention, the optimum addition amount thereof is preferably selected according to the grain size of the silver halide emulsion, the halogen composition, the method and degree of chemical sensitization, the relationship of the layer into which the compound concerned is incorporated with the silver halide emulsion, and the kind of anti-fogging compound, and the test method for the selection thereof is known well to the persons of ordinary skill in the art. Usually, the sensitizing dyes are used preferably in the range of $10^{-7}$ to $1\times10^{-2}$ mole, particularly $1\times10^{-6}$ to $5\times10^{-3}$ mole per mole of silver halide.

The developing agent used in a developing solution containing a di- or trihydroxybenzene compound and a 3-pyrazolidone compound or in a developing solution containing a di- or trihydroxybenzene compound and an aminophenol compound in the absence of a hydrazine compound.

Examples of di- or trihydroxybenzene developing agents which may be used in the invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Hydroquinone is particularly preferred.

Examples of 3-pyrazolidone developing agents or the derivatives thereof include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxy-methyl- 3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

Examples of aminophenol series developing agents which may be used in the present invention include N-methyl-p-aminophenol, p-aminophenol, N-(β-hydroxyethyl)-p-aminophenol, N-(4-hydroxyphenyl) glycine,2-methyl-p-aminophenol, and p-benzylaminophenol. N-methyl-p-aminophenol is preferred.

Usually, the developing agent is used preferably in the amount of 0.05 to 0.8 mol/liter. In the case where a combination of a dihydroxybenzene with a 1-phenyl-3-pyrazolidone or a p-aminophenol is used, the dihydroxybenzene is used preferably in the amount of 0.05 to 0.5 mol/liter and the 1-phenyl-3-pyrazolidone or the p-aminophenol is used preferably in the amount of 0.06 mol/liter or less.

Suitable preservatives which may be used in the present invention include sodium sulfite, potassium sulfite, lithium sulfite, ammonium sulfite, sodium bisulfite, potassium metabisulfite, and sodium formaldehyde bisulfite. Sulfites are added preferably in the amount of 0.3 mole/liter or more, particularly preferably 0.4 mole/liter or more. The upper limit thereof is preferably up to 2.5 mole/liter, particularly preferably up to 1.2 mole/liter.

An alkali agent which may be used for controlling pH includes a pH controlling agent and a buffer agent such as sodium hydroxide, potassium hydroxide, sodium carbonate, potassium carbonate, sodium tertiary phosphate, potassium tertiary phosphate, sodium silicate, and potassium silicate.

There may be contained as additives other than those mentioned above, a development inhibitor such as a compound including boric acid and borax, sodium bromide, potassium bromide, or potassium iodide; an organic solvent such as ethylene glycol, diethylene glycol, triethylene glycol, dimethylformamide, methyl cellosolve, hexylene glycol, methanol, or ethanol; an anti-fogging agent such as a mercapto series compound including 1-phenyl-5-mercaptotetrazole and sodium 2-mercaptobenzimidazole-5-sulfonate, an indazole series compound including 5-nitroindazole, and a benzotriazote series compound including 5-methylbenzotriazole. Further, there may be used according to necessity, a color toning agent, a surface active agent, a deforming agent, a softening agent, and a hardener. In particular, the amino compounds described in JP-A-56-106244 and the imidazole compounds described in JP-B-48-35493 are preferred in terms of the increase in sensitivity they provide.

The compounds described in JP-A-56-24347 may be used in the developing solution used in the present invention as an anti-silver stain agent in combination with a compound of Formula II. Further, the compounds described in JP-A-62-212651 can be used as anti-uneven development agents, and the compounds described in JP-A-61-267759 can be used as dissolution aids.

A fixing solution may be used in the context of the present invention. A fixing solution is an aqueous solution containing a hardener (for example, a water soluble aluminum compound), acetic acid and dibasic acid (for example, tartaric acid, citric acid, and the salts thereof) according to necessity in addition to a fixing agent and preferably has a pH of 3.8 or more, more preferably 4.0 to 5.5.

Sodium thiosulfate and ammonium thiosulfate may be used as the fixing agent.

The amount of the fixing agent to be used is not critical. In general, it is about 0.1 to about 5 mole/liter.

A water soluble aluminum salt which may be used primarily as a hardener in the fixing solution is a compound which is generally known as a hardener for an acidic hardening fixing solution, and includes, for example, aluminum chloride, aluminum sulfate, potassium alum.

Tartaric acid or a derivative thereof and citric acid or a derivative thereof can be used singly or in combinations of two or more kinds thereof as the dibasic acid described above. An effective fixing solution is a fixing solution containing these compounds in the amount of 0.005 mole or more per liter of the fixing agent. Particularly effective is a solution containing these compounds in the amount of 0.01 to 0.03 mole per liter of the fixing solution.

Specific examples of suitable dibasic acids include tartaric acid, potassium tartarate, sodium tartarate, potassium sodium tartarate, ammonium tartarate, and ammonium potassium tartarate.

Citric acid, sodium citrate, and potassium citrate are included as examples of citric acid or the derivatives thereof which are effective in the present invention.

The fixing solution can further contain a preservative (for example, sulfite and bisulfite), a pH buffer agent (for example, acetic acid and boric acid), a pH controlling agent (for example, ammonia and sulfuric acid), an image preservation improver (for example, potassium iodide), and a chelating agent according to necessity. The pH buffer agent is used in the amount of 10 to 40 g/liter, preferably not much more than 18 to 25 g/liter since the pH of the developing solution is high.

The light-sensitive material of the present invention can be processed with replenishing treating solutions depending on an area of the photosensitive material processed. The light-sensitive material of the present invention shows advantages that the photographic properties is hardly deteriorated even if an amount of the replenisher is so reduced.

Thus, according to the present invention, an amount of replenisher for treating solutions, specially developing and fixing solutions, may be set at 200 ml/m$^2$ or less.

Various additives which may be used in the light-sensitive material according to the present invention are not specifically limited, and those described in, for example, the corresponding portions shown below can preferably be used:

| Item | Corresponding portion |
|---|---|
| 1) Surface active agent & | Right upper column, line 7 at p. 9 to right lower column line 7 of |

-continued

| Item | Corresponding portion |
|---|---|
| anti-electri-fication agent | JP-A-2-12236, and left lower column, line 13 at p. 2 to right lower column, line 18 at p. 4 of JP-A-2-18542. |
| 2) Anti-fogging agent & stabilizer | Right lower column, line 19 at p. 17 to right upper column, line 4 at p. 18 and right lower column, lines 1 to 5 of JP-A-2-103536. |
| 3) Polymer latex | Left lower column, lines 12 to 20 at p. 18 of JP-A-2-103536. |
| 4) Compound having an acid group | Right lower column, line 6 at p. 18 to left upper column, line 1 at p. 19 of JP-A-2-103536, and right lower column, line 13 at p. 8 to left upper column, line 8 at p. 11 of JP-A-2-55349. |
| 5) Polyhydroxy-benzenes | Left upper column, line 9 to right lower column, line 17 at p. 11 of JP-A-2-55349. |
| 6) Matting agent, sliding agent, & plasticizer | Left upper column, line 15 to right upper column, line 15 at p. 19 of JP-A-2-103536. |
| 7) Hardener | Right upper column, lines 5 to 17 at p. 18 of JP-A-2-103536. |
| 8) Dye | Right lower column, lines 1 to 18 at p. 17 of JP-A-2-103536, and right upper column, line 1 at p. 4 to right upper column, line 5 at p. 6 of JP-A-2-39042. |
| 9) Binder | Right lower column, lines 1 to 20 at p. 3 of JP-A-2-18542. |
| 10) Developing solution and developing method | Right lower column, line 1 to left upper column, line 10 at p. 13 of JP-A-2-55349. |

The following examples illustrate the invention in more detail, but are not intended to limit the invention in any way.

EXAMPLE 1

Emulsion A was prepared as follows:

| Preparation of Emulsion A | |
|---|---|
| Solution 1: | |
| Water | 1 liter |
| Gelatin | 20 g |
| Sodium chloride | 4.0 g |
| 1,3-Dimethylimidazolidine-2-thione | 30 mg |
| Sodium benzenesulfonate | 6 mg |
| Solution 2: | |
| Water | 400 ml |
| Silver nitrate | 100 g |
| Solution 3: | |
| Water | 400 ml |
| Sodium chloride | 27.1 g |
| Potassium bromide | 21.0 g |
| Potassium hexachloroiridate (III) (0.001% aqueous solution) | 5 ml |
| Potassium hexachlororhodate (III) (0.001% aqueous solution) | amount shown in Table 1 |

Solution 2 and Solution 3 were simultaneously added to Solution 1 maintained at 40° C. and pH 4.5 over a period of 15 minutes while stirring to form nuclear or core grains of 0.20 μm average grain size. Subsequently, the following Solution 4 and Solution 5 were added over a period of 15 minutes. Further, potassium iodide 0.15 g was added to finish the grain formation.

-continued

| | |
|---|---|
| Solution 4: | |
| Water | 400 ml |
| Silver nitrate | 100 g |
| Solution 5: | |
| Water | 400 ml |
| Sodium chloride | 27.1 g |
| Potassium bromide | 21.0 g |
| Potassium hexacyanoferrate (II) (0.1% aqueous solution) | 15 ml |

Subsequently, the emulsion thus prepared was washed by a conventional flocculation method and gelatin 30 g was added.

The pH was adjusted to 5.5 and the pAg was adjusted to 7.5, and sodium thiosulfate 3.7 mg and chlorauric acid 6.2 mg were added thereto, whereby the emulsion was subjected to a chemical sensitization to an optimum sensitivity at 65° C.

Further, there were added 4-hydroxy-6-methyl-1,3,3a,7-tetrazaindene 200 mg as a stabilizer, and phenoxyethanol as an antiseptic agent, whereby there was obtained a silver bromochloroiodide cubic emulsion finally containing 70 mole % silver chloride and having an average grain size of 0.25 μm. This emulsion was designated Emulsion A.

Sensitizing Dye (1) was added to Emulsion A in an amount of $1\times10^{-3}$ mole/mole Ag to provide an ortho sensitization. The sensitivities and gradations are shown in Table 1.

TABLE 1

| Emulsion No. | $K_3PhCl_6$ (mole/mole Ag) | Relative sensitivity | Sensitivity difference* | Gradation |
|---|---|---|---|---|
| A-1 | $1.0\times10^{-7}$ | 158 | +0.2 | 5.0 |
| A-2 | $1.3\times10^{-7}$ | 126 | +0.1 | 5.5 |
| A-3 | $1.7\times10^{-7}$ | 100 | 0 | 5.9 |

*: Sensitivity difference with respect to Emulsion A-3 (log E).

Preparation of the coated sample

As described above, Sensitizing Dye (1) was added to Emulsion A in the amount of $1\times10^{-3}$ mole/mole Ag to subject the emulsion to an ortho sensitization. There were further added hydroquinone and 1-phenyl-5 -mercaptotetrazole as an anti-fogging agent in the amounts of 1.5 g and 50 mg per mole of Ag, respectively, a polyethyl acrylate latex as a plasticizer in the ratio of 25% based on the amount of gelatin binder, colloidal silica with a grain size of 10 μm in the ratio of 40% based on the amount of gelatin binder, and 2-bis(vinylsulfonylacetoamide)-ethane as a hardener. An upper emulsion layer (o layer) of Ag 1.8 g/m² and a lower emulsion layer (u layer) of Ag 1.8 g/m² were coated on a polyester support to total Ag 3.6 g/m² and gelatin 1.5 g/m². A protective layer having the following composition was coated thereon.

| Lower protective layer: | |
|---|---|
| Gelatin | 1.2 g/m² |
| Sodium benzenethiosulfonate | 4 mg/m² |
| 1,5-Dihydroxy-2-benzaldoxime | 25 mg/m² |
| Polyethyl acrylate latex | 125 mg/m² |
| Silica matting agent with an average particle size of 3.4 μm | 50 mg/m² |
| Compound (1) (gelatin dispersion) | 30 mg/m² |
| Colloidal silica with a particle size of 10 to 20 μm | 30 mg/m² |
| Compound (2) | 5 mg/m² |
| Sodium dodecylbenzenesulfonate | 22 mg/m² |

The support used for the samples in the examples had a back layer and a back protective layer each having the following composition:

| | |
|---|---|
| Back layer: | |
| Gelatin | 2.0 g/m$^2$ |
| Sodium dodecylbenzenesulfonate | 80 mg/m$^2$ |
| Compound (3) | 70 mg/m$^2$ |
| Compound (4) | 70 mg/m$^2$ |
| Compound (5) | 90 mg/m$^2$ |
| 1,3-Divinylsulfonyl-2-propanol | 60 mg/m$^2$ |
| Back protective layer: | |
| Gelatin | 0.5 g/m$^2$ |
| Polymethyl metacrylate (grain size: 4.7 μm) | 30 mg/m$^2$ |
| Sodium decylbenzenesulfonate | 20 mg/m$^2$ |
| Compound (2) | 2 mg/m$^2$ |
| Silicone oil | 100 mg/m$^2$ |

The structure of Sensitizing Dye (1) and Compounds (1) to (5) are show below:

Sensitizing dye (1)

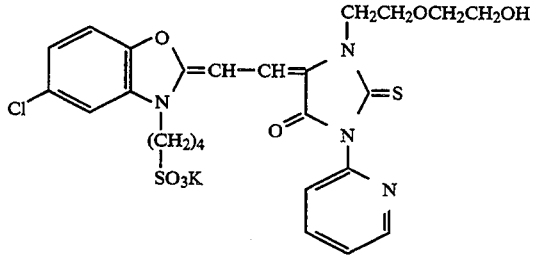

Compound (1)

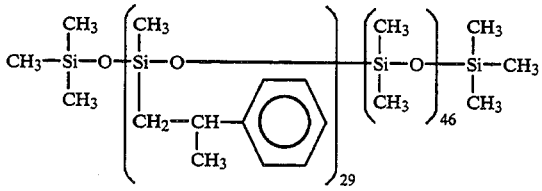

Compound (2)

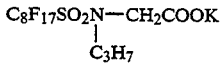

Compound (3)

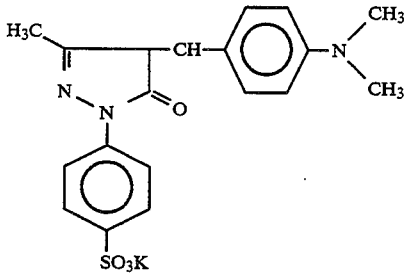

Compound (4)

-continued

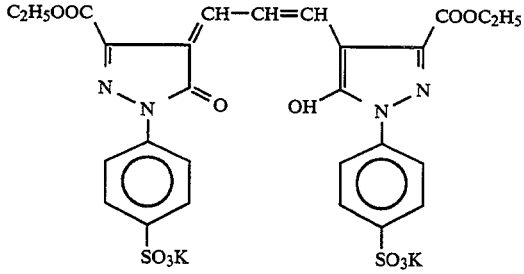

Compound (5)

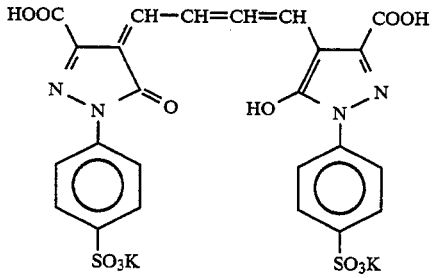

Evaluation of the samples

The samples thus obtained were exposed with a tungsten light source via a step wedge and subjected to a development processing with an automatic developing machine FG-460A manufactured by Fuji Photo Film Co., Ltd., wherein the Developing Solution A and Fixing Solution A each having the following composition were used for a developing solution and a fixing solution, respectively.

Further, Sample No. 1 which was blackened by 80% was subjected to a processing of 600 m$^2$ with the automatic developing machine FG-460A in the Developing Solution A and Fixing Solution A with the replenishing amounts of 180 ml/m$^2$ and 300 ml/m$^2$, respectively, whereby the Running Developing Solution B, the Running Fixing Solution B, the Running Developing Solution C, and the Running Fixing Solution C were prepared. Then, the respective samples exposed with the tungsten light source were processed.

The sensitivity was given by the reciprocal of the exposure providing a density of 3.0 and was expressed by a relative sensitivity, which is shown in Table 2. The gradation was expressed by the gradient of the linear line obtained by connecting the point of the density 0.1 with the point of the density 3.0 in the characteristic curve, which is similarly shown in Table 2.

| Developing Solution A: | |
|---|---|
| Replenishing solution: | |
| Sodium 1,2-dihydroxybenzene-3,5-disulfonate | 0.5 g |
| Diethylenetriaminepentacetic acid | 2.0 g |
| Sodium carbonate | 5.0 g |
| Boric acid | 10.0 g |
| Potassium sulfite | 85.0 g |
| Sodium bromide | 6.0 g |
| Diethylene glycol | 40.0 g |
| 5-Methylbenzotriazole | 0.2 g |
| Hydroquinone | 30.0 g |
| 4-Hydroxymethyl-4-methyl-1-phenyl-3-pyrazolidone | 1.6 g |
| 2,3,5,6,7,8-hexahydro-2-thioxo-4-(1H)-quinazolinone | 0.09 g |
| Sodium 2-mercaptobenzimidazole-5-sulfonate | 0.3 g |

-continued

| Developing Solution A: | |
|---|---|
| Water to make | 1 liter |
| PH (Adjusted with Potassium hydroxide) | 10.7 |
| Starter: | |
| Acetic acid (90%) | 366 g |
| Water to make | 1 liter |

In starting the running, the above starter 10 ml was added to the above replenishing solution 1 liter.

plenishing amounts of the developing solution and the fixing solution scarcely caused any deterioration of the performances and an image having a high contrast could still be formed.

EXAMPLE 2

Coated samples were prepared in the same manner as in Example 1, except that the gelatin amount of the protective layer was changed to the amount shown in Table 3.

The samples were evaluated in the same manner as in Example 1. The results are shown in Table 3.

TABLE 3

| Sample No. | Emulsion in uL*1 | Emulsion in oL*2 | Gelatin (g/m²) PL*3 | Gelatin (g/m²) EL*4 + PL | Developer A/Fixer A Relative sensitivity | Developer A/Fixer A Gradation | Developer B/Fixer B Relative sensitivity | Developer B/Fixer B Gradation | Developer C/Fixer C Relative sensitivity | Developer C/Fixer C Gradation |
|---|---|---|---|---|---|---|---|---|---|---|
| 1 | A-1 | A-1 | 1.2 | 2.7 | 158 | 5.0 | 155 | 4.9 | 126 | 4.4 |
| 2 | A-1 | A-1 | 1.0 | 2.5 | 158 | 5.0 | 158 | 5.0 | 126 | 4.4 |
| 3 | A-1 | A-1 | 0.8 | 2.3 | 158 | 5.0 | 158 | 5.0 | 126 | 4.4 |
| 4 | A-1 | A-1 | 0.5 | 2.0 | 158 | 5.0 | 158 | 5.0 | 129 | 4.5 |
| 5 | A-2 | A-2 | 1.2 | 2.7 | 126 | 5.5 | 123 | 5.3 | 102 | 4.8 |
| 6 | A-2 | A-2 | 1.0 | 2.5 | 126 | 5.5 | 126 | 5.4 | 105 | 4.9 |
| 7 | A-2 | A-2 | 0.8 | 2.3 | 126 | 5.5 | 126 | 5.4 | 105 | 4.9 |
| 8 | A-2 | A-2 | 0.5 | 2.0 | 126 | 5.5 | 126 | 5.4 | 105 | 4.9 |
| 9* | A-1 | A-2 | 1.2 | 2.7 | 148 | 6.6 | 148 | 6.6 | 138 | 6.4 |
| 10* | A-1 | A-2 | 1.0 | 2.5 | 148 | 6.6 | 148 | 6.6 | 145 | 6.5 |
| 11* | A-1 | A-2 | 0.8 | 2.3 | 148 | 6.6 | 148 | 6.6 | 145 | 6.5 |
| 12* | A-1 | A-2 | 0.5 | 2.0 | 148 | 6.6 | 148 | 6.6 | 145 | 6.5 |
| 13* | A-2 | A-1 | 1.2 | 2.7 | 129 | 4.6 | 126 | 4.5 | 100 | 4.0 |
| 14* | A-2 | A-1 | 1.0 | 2.5 | 129 | 4.6 | 129 | 4.6 | 100 | 4.0 |
| 15 | A-2 | A-1 | 0.8 | 2.3 | 129 | 4.6 | 129 | 4.6 | 100 | 4.0 |
| 16 | A-2 | A-1 | 0.5 | 2.0 | 129 | 4.6 | 129 | 4.6 | 102 | 4.1 |

*: Invention
*1: u layer
*2: o layer
*3: Protective layer
*4: Emulsion layer

| Fixing Solution A: | |
|---|---|
| Composition of the fixing solution: | |
| Sodium thiosulfate | 1.1 mole/l |
| Ammonium thiosulfate | 0.2 mole/l |
| Sodium sulfite | 0.1 mole/l |
| Sodium metabisulfite | 0.08 mole/l |
| Disodium ethylenedianinetetraacetate dihydrate | 0.1 g/l |
| Water to make | 1 liter |
| pH (adjusted with potassium hydroxide) | 6.0 |

As can be seen from the results shown in Table 3, the use of a gelatin amount on the emulsion layer side of less than 2.5 g/m² enabled stable formation of an image having a high contrast even with a low replenishing amount.

EXAMPLE 3

Preparation of Emulsion B

Emulsion B was prepared in the same manner as in Emulsion A in Example 1, except that the conditions of the chemical sensitization in Emulsion A were changed

TABLE 2

| Sample No. | Emulsion in u layer | Emulsion in o layer | u layer S* − o layer S (log E) | Developer A/Fixer A Relative sensitivity | Developer A/Fixer A Gradation | Developer B/Fixer B Relative sensitivity | Developer B/Fixer B Gradation | Developer C/Fixer C Relative sensitivity | Developer C/Fixer C Gradation |
|---|---|---|---|---|---|---|---|---|---|
| 1 | A-1 | A-1 | 0 | 158 | 5.0 | 155 | 4.9 | 126 | 4.4 |
| 2 | A-2 | A-2 | 0 | 126 | 5.5 | 123 | 5.3 | 102 | 4.8 |
| 3 | A-3 | A-3 | 0 | 100 | 5.9 | 98 | 5.8 | 81 | 5.4 |
| 4** | A-1 | A-2 | +0.1 | 148 | 6.6 | 148 | 6.6 | 138 | 6.4 |
| 5** | A-1 | A-3 | +0.2 | 141 | 7.0 | 141 | 7.0 | 132 | 6.7 |
| 6 | A-2 | A-1 | −0.1 | 129 | 4.6 | 126 | 4.5 | 100 | 4.0 |
| 7** | A-2 | A-3 | +0.1 | 120 | 7.3 | 120 | 7.3 | 112 | 7.0 |
| 8 | A-3 | A-1 | −0.2 | 105 | 4.3 | 102 | 4.3 | 83 | 3.8 |
| 9 | A-3 | A-2 | −0.1 | 102 | 5.0 | 100 | 4.9 | 81 | 4.4 |

*: Sensitivity
**: Invention

As is apparent from the results shown in Table 2, the use of a silver halide photographic material having two silver halide emulsion layers having different sensitivities, with the emulsion layer having the higher sensitivity being closer to the support, allowed the formation of an image having a high contrast, which is suitable for a plate making light-sensitive material, without using the development effect. Further, the reduction of the reto pH 5.9, pAg 7.5, the temperature 65° C., sodium thiosulfate 2.0 mg, triphenylphosphine selenide 3.0 mg, chlorauric acid 6 mg, sodium benzenethiosulfonate 4 mg, and sodium benzenesulfinate 1 mg.

The sensitivities obtained when subjecting Emulsion B to an ortho sensitization by adding $1\times10^{-3}$ mole/- mole Ag of the Sensitizing Dye (1) shown in Example 1 are shown in Table 4.

TABLE 4

| Emulsion No. | $K_3PhCl_6$ (mole/mole Ag) | Relative sensitivity | Sensitivity difference* | Gradation |
|---|---|---|---|---|
| A-1 | $1.0 \times 10^{-7}$ | 158 | +0.2 | 5.0 |
| A-2 | $1.3 \times 10^{-7}$ | 126 | +0.1 | 5.5 |
| A-3 | $1.7 \times 10^{-7}$ | 100 | 0 | 5.9 |
| B-1 | $1.3 \times 10^{-7}$ | 158 | +0.2 | 5.5 |
| B-2 | $1.7 \times 10^{-7}$ | 126 | +0.1 | 5.9 |
| B-3 | $2.0 \times 10^{-7}$ | 100 | 0 | 6.3 |

*: Sensitivity difference with respect to Emulsion A-3 (log E).

Preparation of the coated samples

Emulsion A and Emulsion B were used to prepare coated samples and the samples were then evaluated in the same manner as those in Example 1. The results are shown in Table 5.

TABLE 5

| Sample No. | Emulsion in u layer | Emulsion in o layer | u layer S* − o layer S (log E) | Developer A/Fixer A Relative sensitivity | Developer A/Fixer A Gradation | Developer B/Fixer B Relative sensitivity | Developer B/Fixer B Gradation | Developer C/Fixer C Relative sensitivity | Developer C/Fixer C Gradation |
|---|---|---|---|---|---|---|---|---|---|
| 1 | A-1 | A-1 | 0 | 158 | 5.0 | 155 | 4.9 | 126 | 4.4 |
| 2 | A-2 | A-2 | 0 | 126 | 5.5 | 123 | 5.3 | 102 | 4.8 |
| 3 | A-3 | A-3 | 0 | 100 | 5.9 | 98 | 5.8 | 81 | 5.4 |
| 4 | B-1 | B-1 | 0 | 158 | 5.5 | 158 | 5.5 | 135 | 4.9 |
| 5 | B-2 | B-2 | 0 | 126 | 5.9 | 126 | 5.9 | 107 | 5.5 |
| 6 | B-3 | B-3 | 0 | 100 | 6.3 | 100 | 6.3 | 83 | 5.7 |
| 7 | A-2 | A-1 | −0.1 | 129 | 4.6 | 126 | 4.5 | 100 | 4.0 |
| 8** | A-2 | A-3 | +0.1 | 120 | 7.3 | 120 | 7.3 | 112 | 7.0 |
| 9 | A-2 | B-1 | −0.1 | 129 | 5.3 | 129 | 5.2 | 102 | 4.6 |
| 10 | A-2 | B-2 | 0 | 126 | 5.7 | 126 | 5.7 | 100 | 5.1 |
| 11** | A-2 | B-3 | +0.1 | 123 | 7.6 | 123 | 7.6 | 117 | 7.3 |
| 12 | B-2 | A-1 | −0.1 | 129 | 4.8 | 129 | 4.8 | 102 | 4.2 |
| 13 | B-2 | A-2 | 0 | 126 | 5.7 | 126 | 5.7 | 102 | 5.2 |
| 14** | B-2 | A-3 | +0.1 | 123 | 7.4 | 123 | 7.4 | 117 | 7.1 |
| 15 | B-2 | B-1 | −0.1 | 129 | 5.4 | 129 | 5.4 | 105 | 4.7 |
| 16** | B-2 | B-3 | +0.1 | 123 | 7.8 | 123 | 7.8 | 120 | 7.6 |

*: Sensitivity
**: Invention

As is apparent from the results summarized in Table 5, the chemical sensitization of the silver halide grains contained in at least one of the silver halide emulsion layers with a sensitizer provides a higher sensitivity and enables the formation of an image having a further higher contrast.

While the invention has been described in detail and with reference to specific embodiments thereof, it will be apparent to one skilled in the art that various changes and modifications can be made therein without departing from the spirit and scope thereof.

What is claimed is:

1. A method for forming an image, comprising processing a silver halide photographic material having on a support at least two silver halide emulsion layers having different sensitivities, the emulsion layer closer to the support having the higher sensitivity, in a developing solution containing a di- or trihydroxybenzene compound and a 3-pyrazolidone compound or in a developing solution containing a di- or trihydroxybenzene compound and an aminophenol compound in the absence of a hydrazine compound, wherein a characteristic curve obtained has a gradient ($\gamma$) of 6.0 or more in the segment of the curve from D=0.1 to D=3.0 where D is the density.

2. The method of claim 1, wherein said processing of the silver halide photographic material is with an automatic developing machine in which the replenishing amounts of developing solution and fixing solution are each 200 ml/m$^2$ or less, respectively.

3. The method of claim 1, wherein at least one emulsion layer contains gelatin and the total amount of gelatin in all layers on the silver halide emulsion layer side of the support is 2.5 g/m$^2$ or less.

4. The method of claim 1, wherein silver halide grains present in at least one silver halide emulsion layer are sensitized with at least one selenium sensitizer.

5. The method of claim 4, wherein the selenium sensitizer or sensitizers are selected from the group consisting of selenium compounds represented by Formulae (I) and (II):

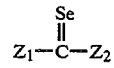

(I)

wherein $Z_1$ and $Z_2$ may be the same or different and each represents an alkyl group, an alkenyl group, an aralkyl group, an aryl group, a heterocyclic group, $—NR_1(R_2)$, $—OR_3$, or $—SR_4$;

$R_1$, $R_2$, $R_3$, and $R_4$ may be the same or different and each represents an alkyl group, an aralkyl group, an aryl group, or a heterocyclic group;

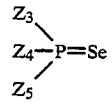

(II)

wherein $Z_3$, $Z_4$ and $Z_5$ may be the same or different and each represents an aliphatic group, an aromatic group, a heterocyclic group, $—OR_7$, $—NR_8(R_9)$, $—SR_{10}$, $—SeR_{11}$, X, or a hydrogen atom;

$R_7$, $R_{10}$ and $R_{11}$ each represents an aliphatic group, an aromatic group, a heterocyclic group, a hydrogen atom, or a cation;

$R_8$ and $R_9$ each represents an aliphatic group, an aromatic group, a heterocyclic group, or a hydrogen atom;

and X represents a halogen atom.

6. The method of claim 4, wherein the amount of the selenium sensitizer or sensitizers is about $1 \times 10^{-8}$ mol per mol of silver in the layer or layers containing the selenium sensitizer or sensitizers.

7. The method of claim 4, wherein the silver halide grains comprise grains sensitized in the presence of a silver halide solvent.

* * * * *